US005447413A

United States Patent [19]

Maier et al.

[11] Patent Number: 5,447,413

[45] Date of Patent: Sep. 5, 1995

[54] STATOR ENDWALL FOR AN ELASTIC-FLUID TURBINE

[75] Inventors: William Maier, Almond; John Waggott, Wellsville, both of N.Y.

[73] Assignee: Dresser-Rand Company, Corning, N.Y.

[21] Appl. No.: 282,221

[22] Filed: Jul. 28, 1994

Related U.S. Application Data

[63] Continuation of Ser. No. 860,954, Mar. 31, 1992, abandoned.

[51] Int. Cl.[6] ..... F01D 1/00

[52] U.S. Cl. ..... 415/181; 415/199.5; 415/914

[58] Field of Search ..... 415/181, 182.1, 183, 415/198.1, 191, 199.4, 199.5, 902, 903, 914, 208.1

[56] References Cited

U.S. PATENT DOCUMENTS

| | | | |
|---|---|---|---|
| 785,066 | 3/1905 | Farwell | 415/191 |
| 1,547,371 | 7/1925 | Emerson | 415/182.1 |
| 2,594,042 | 4/1952 | Lee | 416/189 R |
| 2,785,849 | 3/1957 | Stalker | 415/199.5 |
| 2,839,239 | 6/1958 | Stalker | 415/181 |
| 2,846,137 | 8/1958 | Smith, Jr. | 415/914 |
| 2,974,858 | 3/1961 | Koffel et al. | 415/181 |
| 4,365,932 | 12/1982 | Arnaudeau | 415/199.5 |
| 4,371,311 | 2/1983 | Walsh | 415/199.5 |
| 4,606,700 | 8/1986 | Brudny-Chelyadinov et al. | 415/199.5 |
| 4,778,338 | 10/1988 | Bessay | 415/914 |

FOREIGN PATENT DOCUMENTS

| | | | |
|---|---|---|---|
| 988736 | 8/1951 | France | 415/914 |
| 596784 | 2/1948 | United Kingdom . | |
| 729382 | 5/1980 | U.S.S.R. | 415/199.5 |

*Primary Examiner*—John T. Kwon

*Attorney, Agent, or Firm*—Nixon, Hargrave, Devans & Doyle

[57] ABSTRACT

Outer and inner endwall sections are so profiled that, essentially, the flowpath is straight or flat in the direction of flow. The profiles are defined by lines of revolution about a centerline of a turbine, and shaped as projections upstream from blade tips or bases, tangent to such blade tips or bases, axially, and radially, conforming to a mean obtaining between convex and concave surfaces of the nozzle.

9 Claims, 1 Drawing Sheet

STATOR ENDWALL FOR AN ELASTIC-FLUID TURBINE

This application is a continuation of application Ser. No. 07/860,954, filed Mar. 31, 1992, now abandoned.

This invention pertains to turbines and in particular to an improved endwall, for a turbine, having a unique geometry which offers an elimination of radial pressure gradient.

Turbine stage efficiency can be significantly improved if the radial pressure gradient, the variation therein, in the fluid stream can be minimized or eliminated. Prior art has addressed this matter, albeit with limited success. U.S. Pat. No. 4,778,338, issued to Raymond Bessay, for a Turbine Stage, on Oct. 18, 1988, discloses a contouring of endwalls to modify radial pressure distributions. However, rather than eliminating or minimizing the radial pressure gradient, it sets forth means for matching the radial pressure gradient to the tangential gradient. This approach helps to limit secondary flow losses in the mainstream, but for short stages a much more significant over-shroud leakage results therefrom. To achieve the objects of the invention, the patentee presents an endwall profile which is sinusoidal.

In a British Patent, No. 596,784, of 28 Aug. 1944, issued to The British Thomson-Houston Company, Limited, the patentee does seek to eliminate radial pressure gradients. To this end, it sets forth a toroidal endwall configuration. The latter creates curvature in the radial/axial plane which, in turn, creates a centrifugal force on the fluid in opposition to the radial force arising from a cylindrically-shaped, fluid flowpath. Now, as the centers of revolution for the toroid are substantially the same for both the inner and the outer endwall sections, the forces are precisely balanced at only one radial/axial point. Too, the transition from far upstream to the constant curvature at the nozzle exit is quite severe. More significantly, to practice this concept, it is necessary for the nozzles and rotating blades to be warped, in order that they can accommodate the flow vectors proceeding from both axial and circumferential curvatures.

We believe that what has long been sought are endwalls designed as to eliminate the radial pressure gradient, albeit with a sophisticated, continuous shape which, essentially, makes the flowpath straight or flat in the direction of flow.

It is an object of this invention to set forth an improved endwall for a stator, for use in an elastic-fluid turbine, which satisfies the aforesaid, long sought object.

Particularly, it is an object of this invention to set forth an improved stator endwall having convex and concave nozzle surfaces, for use in an elastic-fluid turbine having rotating blades with outer, radial tips and inner bases, comprising an outer endwall section having a given profile; wherein said profile is defined by a line (a) of revolution about a centerline of such turbine, (b) shaped as the projection upstream from a blade tip, (c) tangent to said blade tip in the axial view, and (d) in the flow direction, in the radial view, wherein said flow direction is defined by a line (aa) from the blade tip inlet to the stator vane exit, in the direction of stator exit flow, and (bb) from the stator vane exit to the vane inlet, along a line which is the mean of the convex and concave surfaces It is also an object of this invention to disclose an improved stator endwall having convex and concave nozzle surfaces, for use in an elastic-fluid turbine having rotating blades with outer, radial tips and inner bases, comprising an inner endwall section having a given profile; wherein said profile is defined by a line (a) of revolution about a centerline of such turbine, (b) shaped as the projection upstream from a blade base, (c) tangent to said blade base in the axial view, and (d) in the flow direction, in the radial view, wherein said flow direction is defined by a line (aa) from the blade base inlet to the stator vane exit, in the direction of stator vane exit flow, and (bb) from the stator vane exit to the vane inlet, along a line which is the means of the convex and concave surfaces.

Further objects of this invention, as well as the novel features thereof, will become apparent by reference to the following description, taken in conjunction with the accompanying figures, in which.

Figure 1:
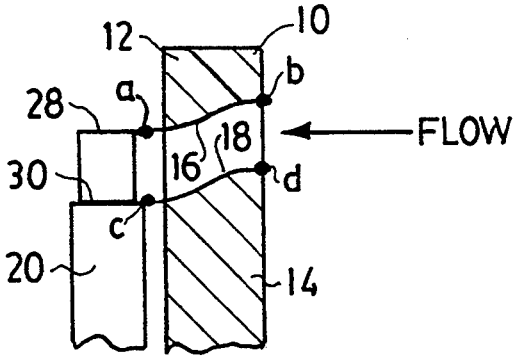
FIG. 1 is a circumferential view of the novel endwall, according to an embodiment of the invention, the same being shown in cross-section, and in association with a rotating blade.

As shown in FIG. 1, the novel endwall 10 has an outer section 12, and an inner section 14, each having a given profile 16 and 18, respectively. The arrow denotes the direction of fluid flow, the same being to the right of the figure, and a portion of an associated rotating blade 20 is shown to the left. The undulating shapes of the profiles 16 and 18 are derived via axial and radial projection, upstream from the rotating blade 20, from a pair of lines of revolution about a centerline of the turbine.

Figure 2:
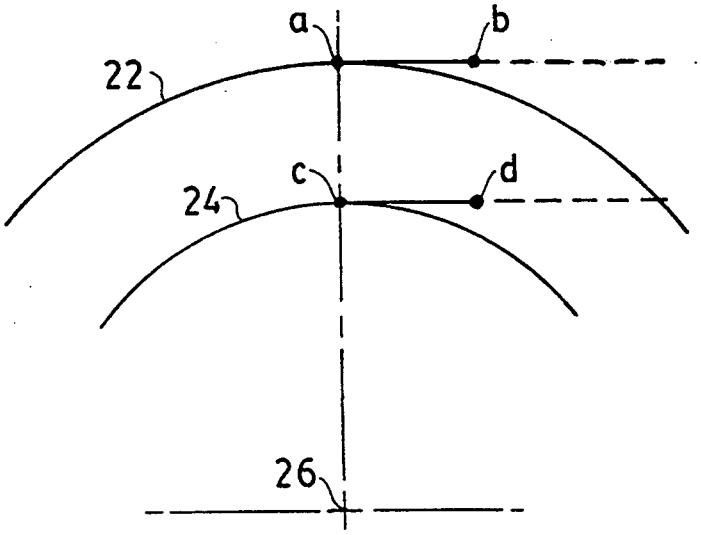
FIG. 2 is an axial depiction of the defining lines for the profiles of the endwall sections.

FIG. 2 depicts the lines of revolution 22 and 24, for the outer endwall section 12 and the inner endwall section 14, respectively, the same being drawn from the centerline 26 of the turbine. In the axial direction, the outer endwall section 12 has its profile defined by an extent, tangent to the tip 28 of the blade 20, obtaining between "a" and "b". Also, in the axial direction, the inner endwall section 14 has its profile defined by an extent, tangent to the base 30 of the blade 20, obtaining between "c" and "d".

Figure 3:
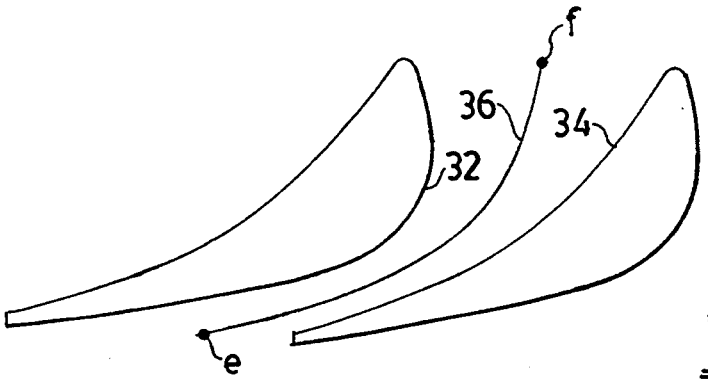
FIG. 3 is a radial view of the convex and concave surfaces of the nozzle.

FIG. 3 shows a radial view of the nozzle, where the convex and concave surfaces 32 and 34, respectively, are illustrated. Inscribed between the surfaces 32 and 34 is a mean line 36 which extends, radially, between "e" and "f". Line 32 comprises the axially-defining component for the profiles 16 and 18, in an embodiment of the invention. In alternative embodiments of the invention, in lieu of the mean between the surfaces 32 and 34, the axially-defining component for the profiles 16 and 18 can comport to either the convex surface 32 or the concave surface 34, or any other representative flow line derived through geometric or fluid dynamic calculation.

While we have described our invention in connection with a specific embodiment thereof, it is to be clearly understood that this is done only by way of example, and not as a limitation to the scope of the invention, as set forth in the objects thereof and in the appended claims. Broadly, our novel endwall 10 has section profiles 16 and 18 which are as straight as possible in the context of an axisymetric configuration. Unlike the referenced British patent, the instant invention does not require warped blades; this is so, as the fluid flow is more or less uniform in both speed and direction at the exit of the nozzle. Because of the constancy of the flow leaving the nozzle, inexpensive, constant-section nozzle, and rotating blade shapes can be considered for larger blade heights for a given pitch diameter, without incurring undue performance penalties.

We claim:

1. In a fluid turbine having a stator axially spaced from and adjacent to a rotor, wherein said stator extends axially from an inlet surface to an outlet surface and comprises radially-spaced inner and outer end walls which radially define an annular space containing a plurality of vanes, each pair of adjacent vanes is spaced to define a fluid flow passage and said rotor has a center line, extends axially from an inlet surface to an outlet surface, and has an annular flow zone defined by inner and outer radial limits, wherein the improvement comprises:

the end walls of said stator have surfaces, taken along an axial cross-sectional view, with a serpentine shape configured to constrain fluid flowing from adjacent the outer end wall of said stator to a plane tangent to the outer radial limit of the annular flow zone inlet for said rotor and radially spaced from the center line and to constrain fluid flowing from the inner end wall of said stator to a plane tangent to the inner radial limit of the annular flow zone inlet for said rotor and radially spaced from the center line, wherein the vanes and the end walls of said stator are configured to eliminate substantially radial pressure gradients.

2. A fluid turbine according claim 1, wherein each of the vanes have a convex surface and a concave surface with the convex surface of one vane and the concave surface of the adjacent vane defining the fluid flow passage.

3. A fluid turbine according to claim 2, wherein the convex and concave surfaces are configured to cause fluid passing through the fluid flow passages to follow a path defined by the mean of the adjacent convex and concave surfaces.

4. A fluid turbine according to claim 2, wherein the convex and concave surfaces are configured to cause fluid passing through the fluid flow passages to follow a path defined by the concave surface.

5. A fluid turbine according to claim 2, wherein the convex and concave surfaces are configured to cause fluid passing through the fluid flow passages to follow a path defined by the convex surface.

6. A fluid turbine according to claim 2, wherein each said rotor has blades in the annular flow zone.

7. A fluid turbine according to claim 2, wherein the end walls of said stator are substantially non-converging.

8. A fluid turbine according to claim 1, wherein the vanes are configured to direct fluid passing through the fluid flow passages of the stator circumferentially about and radially spaced from the center line.

9. A fluid turbine according to claim 1, wherein the inner and outer end walls of said stator are substantially parallel.

* * * * *